US011135619B2

(12) United States Patent
Zhang et al.

(10) Patent No.: US 11,135,619 B2
(45) Date of Patent: Oct. 5, 2021

(54) ORE INTELLIGENCE SORTING APPARATUS AND METHOD BASED ON X-RAYS DISCERNMENT

(71) Applicant: LONGI MAGNET Co., Ltd., Fushun (CN)

(72) Inventors: Chengchen Zhang, Fushun (CN); Zhaopeng Li, Fushun (CN); Yulin Shi, Fushun (CN); Shuangfu Yang, Fushun (CN); Ximing Li, Fushun (CN); Changfu Ji, Fushun (CN); Yang Liu, Fushun (CN); Mingyuan Fan, Fushun (CN); Yuzhu Wang, Fushun (CN); Chunye Xu, Fushun (CN)

(73) Assignee: LONGI MAGNET Co., Ltd., Fushun (CN)

( * ) Notice: Subject to any disclaimer, the term of this patent is extended or adjusted under 35 U.S.C. 154(b) by 143 days.

(21) Appl. No.: 15/751,855

(22) PCT Filed: Jun. 22, 2017

(86) PCT No.: PCT/CN2017/089507
§ 371 (c)(1),
(2) Date: May 6, 2020

(87) PCT Pub. No.: WO2018/149072
PCT Pub. Date: Aug. 23, 2018

(65) Prior Publication Data

US 2020/0282431 A1 Sep. 10, 2020

(30) Foreign Application Priority Data

Mar. 28, 2017 (CN) ..... 201710193752.8

(51) Int. Cl.
*B07C 5/02* (2006.01)
*B07C 5/346* (2006.01)

(52) U.S. Cl.
CPC ..... *B07C 5/346* (2013.01)

(58) Field of Classification Search
CPC ..... B07C 5/346; B07C 5/3425; B07C 5/3427; B07C 5/02
See application file for complete search history.

(56) References Cited

U.S. PATENT DOCUMENTS 4,074,807 A * 2/1978 Goulds ..... B07C 5/02 209/580
4,143,769 A * 3/1979 Ripple ..... B07B 1/282 209/544

(Continued)

FOREIGN PATENT DOCUMENTS

CN 104884179 A 9/2015
CN 105722622 A 6/2016

(Continued)

*Primary Examiner* — Patrick H Mackey
(74) *Attorney, Agent, or Firm* — Craft Chu PLLC; Andrew W. Chu

(57) ABSTRACT

The ore intelligence sorting apparatus and method based on X-rays discernment includes a feeding unit with a toothed classifier, an X ray excitation unit with filter, a characteristic spectrum receiving unit with filter, a computer analysis and control unit with a central control unit, a spectral acquisition system, an industrial computer and an instruction output system, and a separator unit with a cylinder and a wear-resistant kick plate. The feeding unit is fed by a vibrating feeder and grading materials by a toothed classifier, and the measured ore is stimulated by the X ray excitation unit to produce a characteristic x ray spectra. The characteristic spectrum receiving unit receives the characteristic x ray spectrum which is then analyzed by the computer analysis and control unit, and a sorting instruction is output based on the analysis results. The invention is used for sorting magnetic or non-magnetic ores in a concentrator.

7 Claims, 5 Drawing Sheets

(56) References Cited

U.S. PATENT DOCUMENTS

| | | | | |
|---|---|---|---|---|
| 5,236,092 | A * | 8/1993 | Krotkov | B07C 5/02 198/609 |
| 7,041,926 | B1 * | 5/2006 | Gadberry | B07C 5/3425 209/576 |
| 7,763,820 | B1 * | 7/2010 | Sommer, Jr. | B07C 5/346 209/576 |
| 9,884,346 | B2 * | 2/2018 | Bamber | B07C 5/362 |
| 2006/0021918 | A1 * | 2/2006 | Bjork | B07C 5/368 209/682 |
| 2010/0185319 | A1 * | 7/2010 | Petzold | B07C 5/363 700/223 |
| 2015/0314332 | A1 * | 11/2015 | Dimitrakis | G01N 25/20 209/10 |

FOREIGN PATENT DOCUMENTS

| | | | |
|---|---|---|---|
| CN | 106111557 | A | 11/2016 |
| CN | 106881282 | A | 6/2017 |
| DE | 202004018081 | U1 | 2/2005 |
| RU | 2131781 | C1 | 6/1999 |

* cited by examiner

ORE INTELLIGENCE SORTING APPARATUS AND METHOD BASED ON X-RAYS DISCERNMENT

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention belongs to the technical field of ore magnetic separation and specifically relates to an ore intelligence sorting apparatus and method based on X-rays discernment, which is a novel intelligent ore sorting equipment and is suitable for the determination and the simultaneous sorting of a plurality of useful components in ores.

2. Description of Related Art Including Information Disclosed Under 37 CFR 1.97 and 37 CFR 1.98

In the field of mineral sorting, because of the relatively large reserves of iron ore, coal mine and other minerals, it has been widely used in daily production and life, and it has made great progress in mineral sorting technology and mineral sorting equipment. Especially for iron ore, the domestic iron ore mineral processing and equipment have reached a very high standard because of the domestic ore characteristics of more poverty and less wealth, even in the world in a leading position. For rare heavy metals, precious metals, non-metallic minerals whose content being more rare and the distribution being more dispersed, there is no relatively uniform, flexible sorting device for sorting ore.

For an ore containing such valuable elements as copper, gold, silver, molybdenum, nickel, tungsten, lead, zinc, and vanadium, because of its relatively low content in the ore, It will greatly consume manpower, material and financial resources if the ore is directly feed into the crushing grinding stage. Therefore, the ore needs to be preselected. At present, for mineral species being not be sorted by magnetic separation, manual selection is the preferred mode of selection, but there are high separation costs, low efficiency, poor accuracy and so on in manual selection.

BRIEF SUMMARY OF THE INVENTION

In order to solve the above problems, after the present inventor design and research, an ore intelligence sorting apparatus and method based on X-rays discernment is proposed. The technology based on X-rays is used to identify useful elements and their content in ore and is used to sort ore with different content of elements by a sorting unit and can detect and sort ore with multiple elements in a single device.

In accordance with the first aspect of the present invention, an ore intelligence sorting apparatus based on X-rays discernment is proposed which includes a feeding unit 1 with a toothed classifier 16, and a X ray excitation unit 5 with a filter 21, and a characteristic spectrum receiving unit 4 with a filter 19, and a computer analysis and control unit 6 with a central control unit 26, a spectral acquisition system 23, an industrial computer 24 and an instruction output system 25, and a separator unit 3 with a cylinder 10 and wear-resistant kick plate 9; the feeding unit is fed by a vibrating feeder, and materials is graded by means of a toothed classifier, and the measured ore is stimulated by the X ray excitation unit to produce a characteristic x ray spectra, and the characteristic spectrum receiving unit receives characteristic x ray spectrum which is then analyzed by the computer analysis and control unit, and a sorting instructions is output based on the analysis results to use for sorting magnetic or non-magnetic ores in a concentrator.

Preferably, the feeding unit 1 is composed of a feed box 13, a vibrating motor 14, a vibrating platform 17, a fine material passage 12, a fine material groove 15, a chute motor 18 and a chute 11; and the tooth of the toothed classifier 16 is cylindrical and the end of tooth is processed into a cone, and are disposed at the outlet of the vibrating platform 17 and disposed side by side in the direction of discharging material; the cone end of the tooth of the toothed classifier 16 is positioned at the outlet end in the direction of discharging material. The chute 11 is located at the cone end of the tooth of the toothed classifier 16, and an even number chute motor 18 is symmetrically arranged with a chute 11 as the center; and the chute 11 is of U shape, and the distributed material groove can be arranged as needed on the groove surface in the U groove of the chute.

Preferably, the computer analysis control unit 6, the X ray excitation unit 5 and the characteristic spectrum receiving unit 4 are encapsulated in the package case 2; the package case 2 is made of material that can shield X rays. The package case 2 is arranged directly below at the front of the chute 11 and the vertical distance (A dimension) is between 50 mm-230 mm; the horizontal distance (B dimension) from the front edge of the packing case 2 to the exit of the chute 11 is 0 mm-100 mm; the clockwise angle (6 angle) of the package case 2 and the horizontal plane is 0-600.

Further, the central control unit 26 is placed outside the device to transmit signals with the industrial computer 24 in the device via a cable or a wireless connection; one central control unit 26 can be connected with a plurality of industrial control computers 24 simultaneously. A wear-resistant kick plate 9 of the sorting unit 3 is arranged on a supporting rod extending out of the cylinder 10, and the wear-resistant kicking plate 9 is made of wear-resistant material or the wear-resistant kicking plate 9 is provided with wear-resistant material to increase the abrasion resistance.

Preferably, the X ray excitation unit 5 mainly comprises a X ray tube 22, a filter 21, a high-voltage power supply and a constant temperature and humidity device; X ray emitted by the X ray excitation unit 5 can be a point light source to send a circular irradiation region to the material, or send a transverse linear irradiation region; the filter 21 in the X ray excitation unit 5 is positioned between the ore to be measured and the X ray tube 22. The characteristic spectrum receiving unit 4 is composed of a characteristic spectrum receiving sensor 20 and a filter 19, and the filter 19 is between the ore and the characteristic spectrum receiving sensor 20.

In accordance with the second aspect of the present invention, a sorting method using ore intelligence sorting apparatus based on X-rays discernment is proposed which include the following steps:

Step 1, the operator set the corresponding sorting parameters on the basis of the local environmental characteristics, the elements distribution characteristics of an ore to be sorted in the central control unit 26 in a central control room 26, and the parameters are transmitted to the industrial computer 24 by wire or wireless;

Step 2, after the industrial computer 24 receives the sorting parameter set by the central control unit 26, the X ray excitation unit 5 and the characteristic spectrum receiving unit 4 and the feeding unit 1 are opened, and the sorting equipment begin to work;

Step 3, when the ore to be sorted and supplied through the feeding unit 1 falls into the radiation range of the X ray excitation unit 5, the ore is excited by the X ray excitation unit 5 to produce a characteristic spectrum;

Step 4, a characteristic spectral receiving unit 4 receives a characteristic spectra generated by the ore and inputs the characteristic spectrum to the spectral acquisition system 23;

Step 5, the characteristic spectrum is transmitted to the industrial computer 24 after being processed by the spectral acquisition system 23 again, and the industrial computer 24 compares the spectral signals with the sorting parameters transmitted by the central control unit 26 in Step 1, and finally obtains the sorting instructions, and the sorting instruction is output to the sorting unit 3 through the instruction output system 25;

Step 6, the sorting unit 3 executes the sorting instruction after receiving the sorting instruction, and finally completes one sorting;

Step 7, cycling Step 3 to Step 6.

The invention relates to ore intelligence sorting apparatus and method based on X-rays discernment, and it has the advantages of simple structure and reasonable design, and fills the blank of such ore sorting, and is worth popularizing and applying widely. And using ore intelligence sorting apparatus and method, only a single set of equipment can used instead of hand sorting to select target metals, non-metallic minerals, and other rare minerals, then the ore is preselected which isn't preselected in the magnetic separation, and a large number of low-grade or unqualified waste is discarded ahead of time to reduce processing costs, improve processing efficiency and stability of the subsequent ore separation grade.

DETAILED DESCRIPTION OF THE INVENTION

Figure 1:
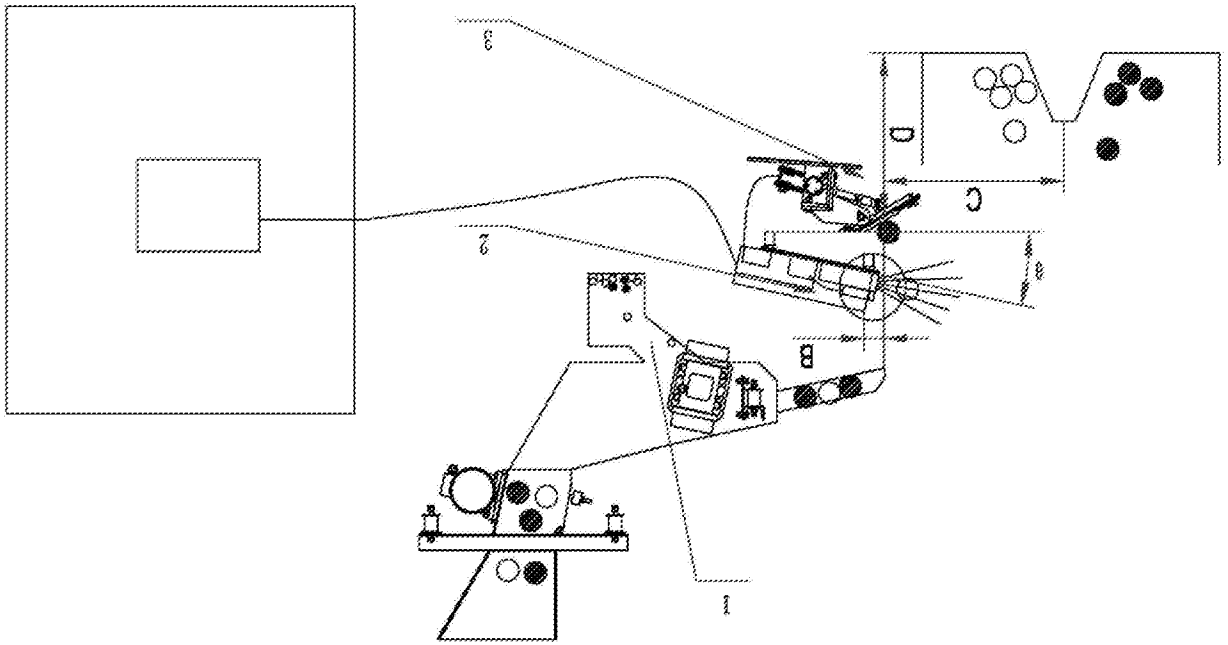
FIG. 1 is a schematic view of a diagram of an intelligent ore sorting device based on X ray identification in accordance with the present invention.
Figure 2:
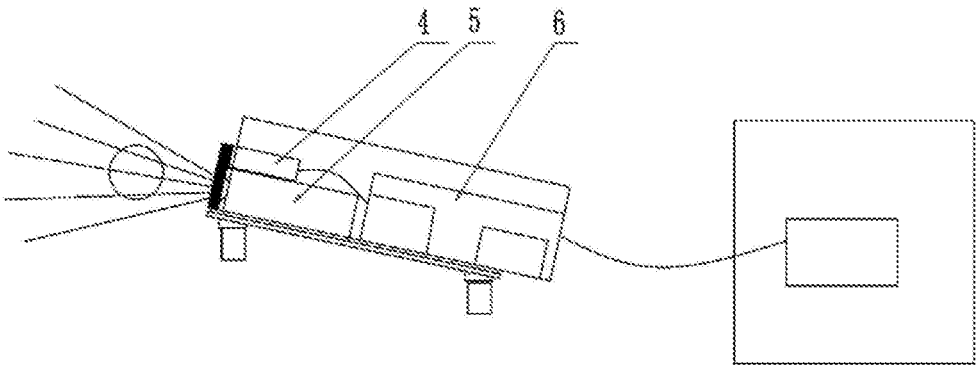
FIG. 2 is a schematic view of a diagram of the package structure of an intelligent ore sorting equipment based on X ray identification.
Figure 3:
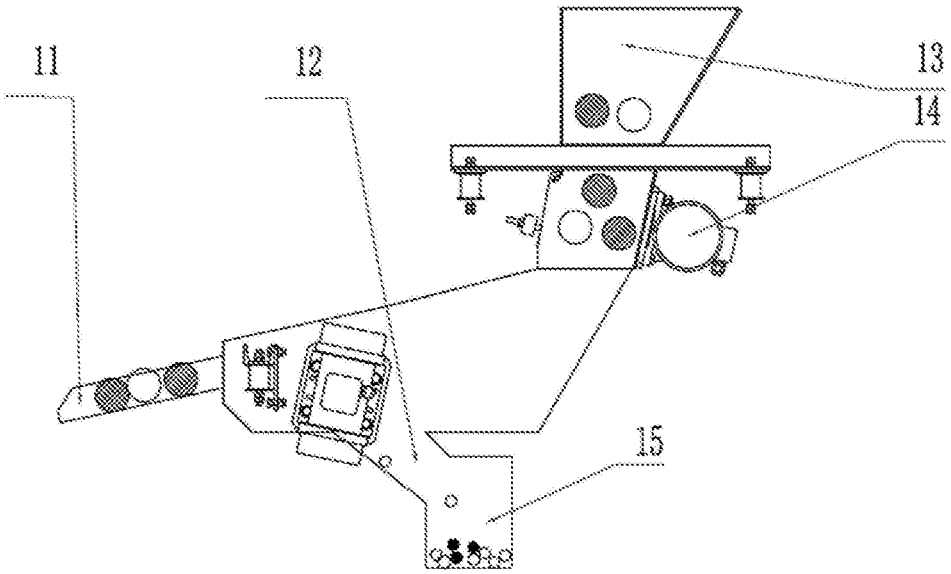
FIG. 3 is a schematic view of a first structure schematic diagram 1 of the feeding unit of an intelligent ore sorting equipment based on X ray identification.
Figure 4:
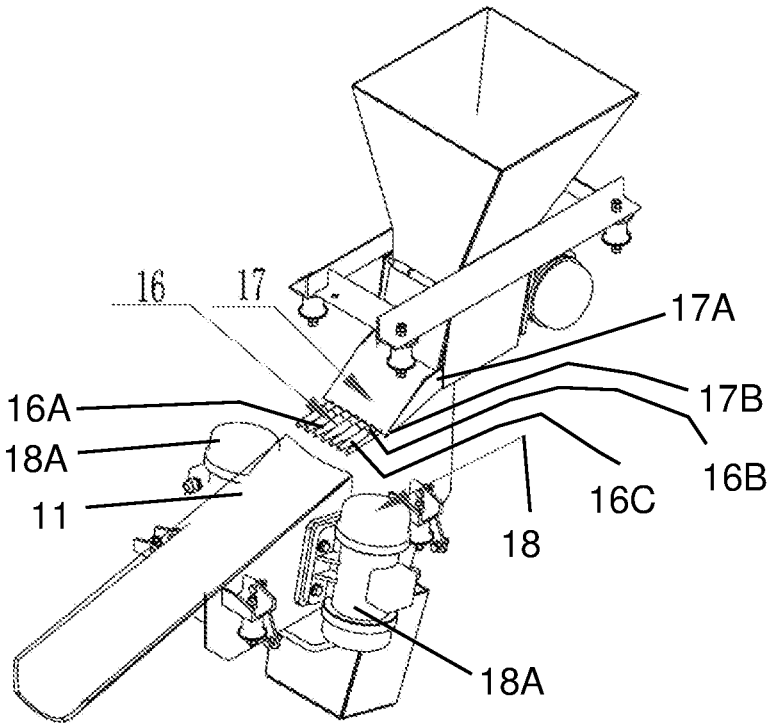
FIG. 4 is a schematic view of a second structure schematic diagram 2 of the feeding unit of an intelligent ore sorting equipment based on X ray identification.
Figure 5:
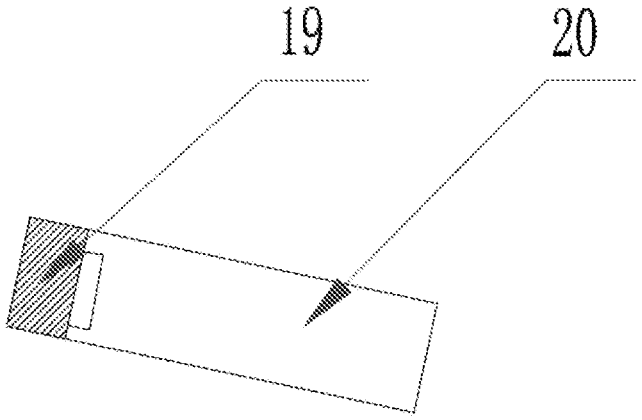
FIG. 5 is a structural schematic view of a diagram of the characteristic spectrum receiving unit of an intelligent ore sorting equipment based on X ray identification.
Figure 6:
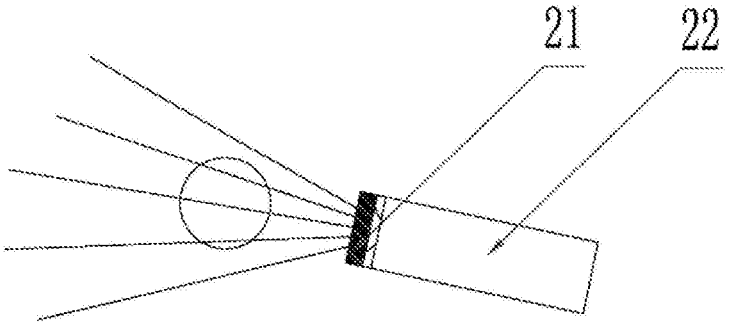
FIG. 6 is a structural schematic view of a diagram of the X ray excitation unit of an intelligent ore sorting equipment based on X ray identification.
Figure 7:
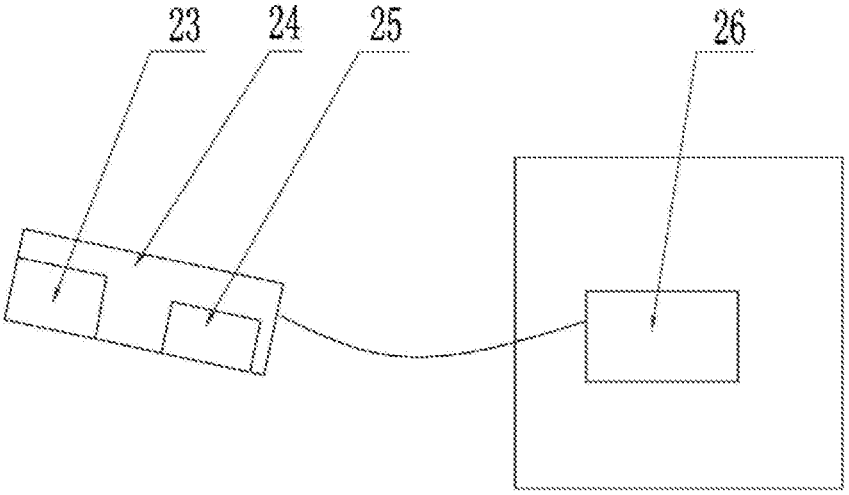
FIG. 7 is a structural schematic view of a diagram of the computer analysis control unit of an intelligent ore sorting equipment based on X ray identification.
Figure 8:
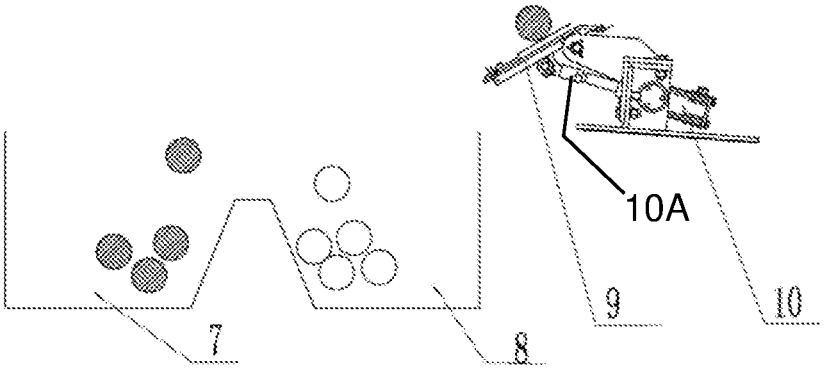
FIG. 8 is a structural schematic view of a diagram of the sorting unit of an intelligent ore sorting equipment based on X ray identification.

The technical solution in embodiments of the present invention is clearly and completely described below with reference to drawings in the embodiments of the present invention. Obviously, the described embodiments are only a portion of embodiments in the present invention but not all the embodiments of the present invention. Based on the embodiments in the present invention, an ordinary person skilled in the art can obtain all other embodiments without involving any inventive effort, which all shall fall within the protective scope of the present invention. Besides, the protective scope of the present invention should not be regarded as limit in the following specific structures or specific parameters.

The intelligent ore sorting device and method based on X ray identification in this invention, which is a X ray ore preselection machine that uses X ray fluorescence or diffraction principle to distinguish useful components and their contents; a device for detecting and sorting a plurality of elements on a single device is provided, which mainly includes a feeding unit, a X ray excitation unit, a characteristic spectrum receiving unit, a computer analysis and control unit and a sorting unit, and the units are interrelated and form a unified whole. The feeding unit is fed by a vibrating feeder, and the material is graded through a toothed classifier; the X ray excitation unit provides the X ray excitation source to the system through the X ray tube, and the X ray is selected suitable for energy through the filter; the characteristic spectrum receiving unit receives the characteristic spectrum through the characteristic spectrum receiving sensor; the computer control unit collects the characteristic spectrum through the spectral acquisition system, and the spectral signals are analyzed by an industrial computer, the sorting instruction is output by command output system; and using a wear-resistant kick plate, an electromagnetic push rod or a nozzle to sort ore in the sorting unit; the workflow is as follows: the feeding unit provides material for the sorting machine, and X ray excitation unit encourages the ore to be measured to produce characteristic x ray spectrum, and the characteristic spectral receiving unit then receives a characteristic x ray spectrum, and the computer analysis and control unit analyzes the spectrum and output the sorting instructions based on the analysis results. Finally, the sorting instruction is executed by the sorting unit. The invention can be used for sorting magnetic or non-magnetic ore in a concentrator, and has the advantages of high product range, high recovery rate, large amount of treatment, low water consumption and high automation degree.

In the present invention, the X ray is a kind of electromagnetic wave with extremely short wavelength and large energy, which has strong fluorescence effect and diffraction effect in crystal. The ore recognition principle used in the invention is as follows: the fluorescence action or diffraction action of X ray is used to identify different substances, and X ray is used to determine the content of useful elements in Ores during ore preselection stage.

In the present invention, a X ray ore preselected machine is provided that uses X ray fluorescence to identify useful components and their contents. The equipment of the invention mainly comprises includes a feeding unit 1 with a toothed classifier 16, and a X ray excitation unit 5 with an X ray excitation filter 21, and a characteristic spectrum receiving unit 4 with a characteristic spectral receiving filter 19, and a computer analysis and control unit 6 with a connection to a central control unit 26, a spectral acquisition system 23, an industrial computer 24, and an instruction output system 25, and a separator unit 3 with a cylinder 10 and wear-resistant kick plate 9; the feeding unit is fed by a vibrating feeder, and materials is graded by means of a toothed classifier, and the measured ore is stimulated by the X ray excitation unit to produce a characteristic x ray spectra, and the characteristic spectrum receiving unit receives characteristic x ray spectrum which is then analyzed by the computer analysis and control unit, and a sorting instructions is output based on the analysis results to use for sorting magnetic or non-magnetic ores in a concentrator.

The feeding unit is composed of a feed box, a vibrating motor, a vibrating platform, a toothed classifier, a fine material passage, a fine material groove, a chute motor and a chute, so as to provide a stable feeding state for the equipment. The X ray excitation unit consists of a X ray source, a high voltage power supply, a filter, and a constant temperature and humidity apparatus, so as to emit stimulated X rays to the ore to be measured; and the characteristic spectrum receiving unit is composed of a characteristic spectrum receiving sensor and a filter, which is used for receiving the characteristic spectrum released by the stimulated X ray of the ore to be measured; the computer analysis and control unit is composed of an industrial computer, a central control unit, a spectrum acquisition system and an instruction output system. It is used to analyze the spectrum received by the sensor, and then output the sorting instructions to the sorting unit. The sorting unit is mainly composed of a cylinder, a wear-resistant kick plate and a fine tailings distributor, so as to perform the sorting instructions produced by the computer analysis and control unit, and then sort the ore to be measured.

Further, the feeding bin of the feeding unit is a trapezoidal bucket which is of big top and small bottom, and a counterweight door is installed at one side of the lower part of feeding bin, and the counterweight is regulated by a thread. The feeding bin is positioned at the top of the electromagnetic vibration feeder and the electromagnetic vibration feeder is connected with the chute. The trough of the chute is a U chute, which ensures that the ore is capable of forming a row of ore streams that are fed into the sensor section of the characteristic spectral receiving unit. There is spacing strip-shaped projection between the inner walls of the chute. According to the processing capacity, the number of chute can be more than 1. The chute has a certain angle with the horizontal direction, and the angle is adjustable. The spring support is arranged between the chute and the frame body. The discharge port of the chute is located on the upper side of the characteristic spectrum receiving unit, and the ore can pass through the sensor of the characteristic spectrum receiving unit just after falling from the chute.

The characteristic spectrum receiving unit is positioned at the lower part of the chute of the feeding unit and is composed of a characteristic spectrum receiving sensor and a filter, wherein the filter is covered on the sensor window. The characteristic spectrum receiving sensor can discriminate a plurality of elements, and the invention can classify a plurality of elements by setting parameters, and the sorting accuracy is high and the efficiency is high. In addition, the characteristic spectral receiving unit can distinguish the ores by X ray fluorescence or X ray diffraction and the like, and the two identification methods correspond to the characteristic spectral receiving units.

The X ray excitation unit is positioned below the characteristic spectrum receiving unit, and is arranged in the same box body with the computer analysis and control unit, and the box body is supported on the bracket by the spring, and in the X ray excitation unit, X rays is first emitted by a X ray tube, and then the filter selects the appropriate energy or wavelength of the X ray to stimulate the ore to be selected according to the characteristics of the ore element to be selected.

The sorting unit is located at the lower part of the box bracket, and mainly composed of a cylinder, an wear-resistant kick plate, a concentrate and tailings separating tank. The sorting instructions of the calculation and analysis separate a mineral with a high content of useful elements and waste rock in the ore by the action of the sorting mechanism. The fine tailing chute is composed of a concentrate receiving tank and a waste rock receiving tank to use for receiving concentrates and waste rock after sorting of raw ore. Wherein the concentrate receiving tank is positioned on the side of the ore containing the element, and whose ore fall through the sorting mechanism and is separated into two falling paths. The waste rock receiving tank is positioned below one side of the waste rock falling. Furthermore, the chute in the feeding unit can also be a flat plate chute, and the chute is provided with a transverse bar shaped bulge. In addition, the sorting mechanism of the sorting unit can also be one or several combinations of a pneumatic kicking board, an electromagnetic kick board, or a jet blowing nozzle, which can be used to change the path of ore falling to separate waste rock and useful minerals.

In summary, the technology of the invention makes the ore from the feeding unit distributing material, and makes ore to be selected release the characteristic spectrum of the ore element which is stimulated by a X ray excitation source, and then the data is passed to the calculation and analysis control unit after the characteristic spectrum receiving unit receives characteristic spectrum of the ore to be measured and the internal data processor performs preliminary processing of the data, and the calculation and analysis control unit calculates the action signal. The sorting mechanism of sorting unit receives the action signal and then performs the sorting operation, separating the waste rock and the ore with high content of the useful elements into two falling paths. The waste rock and the ore with high content of useful elements fall apart and fall into the waste rock receiving tank and the concentrate receiving tank respectively to achieve the purpose of sorting.

The invention is illustrated in conjunction with the drawings below, a X ray ore preselected machine is provided that uses X ray fluorescence to identify useful components and their contents in the present invention which mainly includes the feeding unit 1 with feeding speed adjustable and feed particle size grading, the characteristic spectrum receiving unit 4 which can convert characteristic spectral signals into electrical signals, the sorting unit or separator unit 3 using a cylinder 10 push the wear-resistant kick plate 9, and the computer analysis control unit 6 which can analyze rapidly the signal provided by the characteristic spectrum receiving unit 4 and make a quick response according to the user's setting threshold.

Wherein, the feeding unit 1 is composed of a feed box 13, a vibrating motor 14, a vibrating platform 17, a tooth classifier 16, a fine material passage 12, a fine material groove 15, a chute motor 18 and a chute 11, which is used to provide a stable feeding state of equipment. The feed box 13 is positioned at the top of the feeding unit 1 and is the feed port of the separator unit, the vibrating motor 14 is positioned at the rear side of the feed box 13 to adjust feed rate, the vibrating platform 17 having a platform inlet 17A and a platform outlet 17B is connected with the outlet of the feed box 13 and is used to distribute material for the separator unit. The tooth classifier 16 is connected with the end of the vibration platform 17, the lower part of the tooth classifier 16 is a fine material passage 12 and the bottom of the channel is a fine material groove 15, the tooth classifier 16 is a plurality of teeth 16A, each tooth having cylindrical portions 16B side-by-side and a cone end 16C on an end of the respective cylindrical portion, the cone end being shaped into a taped cone. The chute 11 is along the direction of feeding and the side of the cone end, and an even number of chute motors 18 (two symmetrical motors 18A) are installed on both sides of the center of the chute 11 to adjust the feeding speed of the chute 11. The feeding bin 13 is a trapezoidal bucket which is of big top and small bottom, and a counterweight door is installed at one side of the lower part, and the counterweight is regulated by a thread.

The tooth shape classifier 16 is mainly composed of a plurality of teeth 16A, each tooth having a cylindrical portion 16B, and the cone end 16C. The cone end 16C is at the outlet end of the discharge direction. According to the particle size of the equipment sorting materials, 4-50 tooth classifier 16 are arranged side by side at the exit of the vibrating platform 17 and arranged in the direction of the discharge. The utility model has the function of sieving the ore particles. The fine material is discharged through the fine material passage 12 and the fine material trough or groove 15, both of which are arranged at the bottom of the toothed classifier 16 and have the function of recovering fine materials. The chute motor 18 (two symmetrical motors 18A) and the chute 11 are positioned under the slope of the tooth classifier 16, and the utility model has the function of evenly distributing the ore in a plurality of sorting channels and regulating the speed of the classification ore feeding. The chute 11 is positioned at one end of the cone ends 16C of the tooth classifier 16, and the chute 11 is symmetrically arranged with an even number of chute motors 18 (two symmetrical motors 18A), and the chute is of a U shape, and a projection can be arranged according to the distributed material condition.

The characteristic spectral reception unit 4, the X ray excitation unit 5, and the computer analysis control unit 6 (excluding the central control unit 26) are packaged together by the same cabinet or package box 2. The material can be shielded from X ray radiation. Package box 2 is between the chute 11 just below the vertical distance A size 50 mm-230 mm. The horizontal distance B size is between 0 mm-50 mm, and the package box 2 and the horizontal plane clockwise angle is 0-60 degrees. The X ray stimulating unit 5 and the horizontal plane clockwise angle or θ angle is 0-22 degrees. The center horizontal distance of wear-resisting boot plate 9 of the sorting unit or separator unit 3 from the concentrate and tailings separating mechanism C is 300 mm-1000 mm, the vertical distance is D, and the dimension is 500 mm-1200 mm.

Further, the characteristic spectral reception unit 4 may discriminate the ore by means of X ray fluorescence and X ray diffraction, and the two types of discrimination correspond to the characteristic ray receiving units, which are different embodiments. X ray fluorescence spectrum by the receiving unit 4 is composed by of the characteristic spectral receiving sensor 20 and said characteristic spectral receiving filter 19 and is located in the chute 11 below. The characteristic spectral reception unit 4 received the characteristic spectrum, and the spectral signals were converted to digital signal processing computer recognition. Filter 19 is between the ore as feed material and the characteristic light ray receiving sensor 20.

The X-ray excitation unit 5 includes X ray tube 22, filter 21, and a high voltage power supply. Filter 21 is between ore and X ray tube 22, located in the spectral receiving unit 4 is used to characteristics of X-ray ore elements. The X ray excitation source 5 can be a point light source, which sends a circular irradiation region to the material, and a transverse linear irradiation region can also be sent out. The circular irradiation region is aligned with a channel and can be irradiated individually for an ore. The linear irradiation section allows transverse irradiation of all material falling from the ordinary vibratory feeder.

The sorting unit or separator unit 3 can be pneumatic electromagnetic kick plate. One or several plates or a high pressure gas nozzle, which can be used to change the path to separate the waste rock and ore, are useful. The separator unit 3 is composed of a separator cylinder 10 and wear-resistant kick plate 9, which is arranged below the X ray exciting unit 5 and has an executing mechanism for performing sorting commands in real time. The sorting mechanism or separator unit is further composed of an electromagnetic push rod and a wear-resistant kick plate 9, the position and the function are the same as the pneumatic kick plate. The high pressure gas nozzle sorting mechanism is composed of a high pressure nozzle and a control electromagnetic valve. The position and the function are the same as that of the pneumatic kick plate. The wear-resisting kick plate 9 of the sorting unit or separator unit 3 is arranged on the supporting rod 10A extended out of the cylinder 10, and the wear-resistant kick plate 9 is made of wear-resistant material or is provided with wear-resistant material in the wear-resistant kicking plate 9 to increase the abrasion resistance.

The computer analysis control unit 6 is composed of an industrial control computer 24, a spectrum acquisition system 23 and an instruction output system 25 and is packaged in a box with a X ray excitation unit 5. An insulating spring is arranged between the package box 2 and the frame body to achieve buffer vibration and insulation with the frame body, and another central control machine 26 is placed in the central control room, which is used to set the sorting parameters and monitor the running state of the sorting machine in real time. Each central control machine 26 can be connected with a plurality of industrial control computers at the same time and can be connected by a cable or wireless connection. The central control machine 26 is placed outside the device and connected with the industrial control computer 24 in the device through the network cable, transmitting signals or transmitting signals through a wireless connection. A central control machine 26 can be connected with a plurality of industrial computer 24 at the same time.

The sorting method using the said intelligent ore sorting equipment based on the X ray identification is as follows:

Step 1, the operator set the corresponding sorting parameters on the basis of the local environmental characteristics, the elements distribution characteristics of an ore to be sorted in the central control unit 26 in a central control room 26, and the parameters are transmitted to the industrial computer 24 by wire or wireless;

Step 2, after the industrial computer 24 receives the sorting parameter set by the central control unit 26, the X ray excitation unit 5 and the characteristic spectrum receiving unit 4 and the feeding unit 1 are opened, and the sorting equipment begin to work;

Step 3, when the ore to be sorted and supplied through the feeding unit 1 falls into the radiation range of the X ray excitation unit 5, the ore is excited by the X ray excitation unit 5 to produce a characteristic spectrum;

Step 4, a characteristic spectral receiving unit 4 receives a characteristic spectra generated by the ore and inputs the characteristic spectrum to the spectral acquisition system 23;

Step 5, the characteristic spectrum is transmitted to the industrial computer 24 after being processed by the spectral acquisition system 23 again, and the industrial computer 24 compares the spectral signals with the sorting parameters transmitted by the central control unit 26 in Step 1, and finally obtains the sorting instructions, and the sorting instruction is output to the sorting unit 3 through the instruction output system 2;

Step 6, the sorting unit 3 executes the sorting instruction after receiving the sorting instruction, and finally completes one sorting;

Step 7, cycling Step 3 to Step 6.

Furthermore, the equipment disclosed by the invention can be combined, that is, according to the process parameters or performance requirements used in the field, the sets of equipment used in series, the first sets of equipment as a pre-roughing, the second sets of equipment in series with the first set of equipment for roughing, and third sets of equipment for fine sorting and so on, and then form a complete set of sorting equipment string.

The invention has the advantages of reasonable and novel structure, high safety, energy saving and beautiful appearance, while ensuring the good separation index. The above is only preferred specific embodiments of the invention; however, the scope of protection of the invention is not limited to this. Any modification or substitution that is easy to conceive by a person skilled in the art within the technical scope disclosed in the invention should be included in the scope of protection of the invention. It should be understood by an ordinary person in the art that any variety of modification could be made in format and detail without departing from the spirit and scope of the invention defined by the appended claims.

We claim:

1. An ore intelligence sorting apparatus based on X-rays discernment, the apparatus comprising:

a feeding unit being comprised of:

a feed box, a vibrating motor attached to said feed box;

a vibrating platform being attached to said feed box so as to discharge material from said feed box as discharged material and having a platform inlet and a platform outlet opposite said platform inlet;

a toothed classifier, and at said platform outlet so as to grade said discharged material into a fine material and a feed material;

a chute under said toothed classifier;

a chute motor attached to said chute;

a fine material groove under said chute; and a fine material passage between said fine material groove and said toothed classifier so as to store said fine material from said discharged material in said fine material groove, and wherein said toothed classifier is comprised of a plurality of teeth, each tooth of said plurality of teeth being comprised of a cylindrical portion and a cone end opposite said cylindrical portion, said plurality of teeth being disposed side by side, each cone end of said plurality of teeth facing away from said platform outlet so as to direct said feed material to said chute;

an X ray excitation unit being comprised of an X ray excitation filter and being positioned below said chute so as to stimulate said feed material to generate a characteristic X ray spectra fluorescence;

a characteristic spectral receiving unit being comprised of a characteristic spectral receiving filter and a characteristic spectral receiving sensor and being positioned below said chute so as to receive said characteristic X ray spectra fluorescence, said characteristic spectral receiving filter being positioned between said characteristic spectral receiving sensor and said feed material passing from said chute downward;

a computer analysis control unit being comprised of a spectral acquisition system, an industrial computer connected to said spectral acquisition system, and an instruction output system connected to said industrial computer, said computer analysis control unit being in communication with said characteristic spectral receiving unit; and a separator unit being comprised of a separator cylinder with a supporting rod and wear-resistant kick plate being comprised of a wear-resistant material, said wear-resistant kick plate being arranged on said supporting rod extending from said separator cylinder, said separator unit being positioned below said X ray excitation unit wherein said characteristic spectrum receiving unit is positioned between said feeding unit and said separator unit so as to receive said characteristic x ray spectrum fluorescence, and wherein said characteristic spectrum receiving unit is in communication with said computer analysis control unit so as to analyze said characteristic x ray spectrum fluorescence and to output a corresponding sorting instruction to said separator unit.

2. The ore intelligence sorting apparatus based on X-rays discernment of claim 1, wherein said chute is located at at least one cone end of said plurality of teeth, wherein said chute motor is comprised of two symmetrical motors, said chute being arranged at a center between said two symmetrical motors, and wherein said chute has groove surface with a U shape, said fine material groove being arranged on said groove surface.

3. The ore intelligence sorting apparatus based on X-rays discernment of claim 1, wherein said computer analysis control unit, said X ray excitation unit and said characteristic spectrum receiving unit are encapsulated in a package case; and wherein said package case is comprised of material that can shield X rays.

4. The ore intelligence sorting apparatus based on X-rays discernment of claim 3, wherein said package case is arranged directly below said chute, wherein a vertical distance from said package case and said chute is between 50 mm-230 mm, wherein a horizontal distance from said packing case to said chute is 0 mm-100 mm; and wherein a clockwise angle of said package case and a horizontal plane is 0-60°.

5. The ore intelligence sorting apparatus based on X-rays discernment of claim 1, further comprising: a central control unit in communication with said industrial computer, said central control unit being separated from said computer analysis control unit, said X ray excitation unit and said characteristic spectrum receiving unit, said central control unit being simultaneously connected with a plurality of other industrial control computers.

6. An ore intelligence sorting apparatus based on X-rays discernment, the apparatus comprising:

a feeding unit being comprised of a toothed classifier;

an X ray excitation unit being comprised of an X ray excitation filter and being positioned below said feeding unit so as to stimulate a feed material passing from said feeding unit to generate a characteristic X ray spectra fluorescence;

a characteristic spectral receiving unit being comprised of a characteristic spectral receiving filter and a characteristic spectral receiving sensor and being positioned below said chute so as to receive said characteristic X ray spectra fluorescence, said characteristic spectral receiving filter being positioned between said characteristic spectral receiving sensor and said feed material passing from said feeding unit downward;

a computer analysis control unit being comprised of a spectral acquisition system, an industrial computer connected to said spectral acquisition system, and an instruction output system connected to said industrial computer, said computer analysis control unit being in communication with said characteristic spectral receiving unit; and a separator unit being comprised of a separator cylinder with a supporting rod and wear-resistant kick plate being comprised of a wear-resistant material, said wear-resistant kick plate being arranged on said supporting rod extending from said separator cylinder, said separator unit being positioned below said X ray excitation unit, wherein said characteristic spectrum receiving unit is positioned between said feeding unit and said separator unit so as to receive said characteristic x ray spectrum fluorescence, and wherein said characteristic spectrum receiving unit is in communication with said computer analysis control unit so as to analyze said characteristic x ray spectrum fluorescence and to output a corresponding sorting instruction to said separator unit, wherein said X ray excitation unit further comprises an X ray tube, a high-voltage power supply, and a constant temperature and humidity device, wherein said X ray excitation unit is positioned below said chute so as to emit an X ray as a point light source for sending a circular irradiation region or a transverse linear irradiation region to said feed material or send a transverse linear irradiation region, and wherein said X ray excitation filter is positioned between said feed material and said X ray tube.

7. A sorting method, comprising the following steps:

Step 1, setting sorting parameters based on local environmental characteristics and ore distribution characteristics with a central control unit, wherein said central control unit is in communication an apparatus comprising:

a feeding unit being comprised of a toothed classifier;

an X ray excitation unit being comprised of an X ray excitation filter and being positioned below said feeding unit so as to stimulate a feed material passing from said feeding unit to generate a characteristic X ray spectra fluorescence;

a characteristic spectral receiving unit being comprised of a characteristic spectral receiving filter and a characteristic spectral receiving sensor and being positioned below said chute so as to receive said characteristic X ray spectra fluorescence, said characteristic spectral receiving filter being positioned between said characteristic spectral receiving sensor and said feed material passing from said feeding unit downward;

a computer analysis control unit being comprised of a spectral acquisition system, an industrial computer connected to said spectral acquisition system, and an instruction output system connected to said industrial computer, said computer analysis control unit being in communication with said characteristic spectral receiving unit; and a separator unit being comprised of a separator cylinder with a supporting rod and wear-resistant kick plate being comprised of a wear-resistant material, said wear-resistant kick plate being arranged on said supporting rod extending from said separator cylinder, said separator unit being positioned below said X ray excitation unit, wherein said characteristic spectrum receiving unit is positioned between said feeding unit and said separator unit so as to receive said characteristic x ray spectrum fluorescence, wherein said characteristic spectrum receiving unit is in communication with said computer analysis control unit so as to analyze said characteristic x ray spectrum fluorescence and to output a corresponding sorting instruction to said separator unit, and wherein said sorting parameters are transmitted to said industrial computer;

Step 2, starting said feeding unit, said X ray excitation unit, said characteristic spectrum receiving unit and and said separator unit according to said sorting parameters received by said industrial computer;

Step 3, supplying ore as said material in said feed box, said feed material falling from said chute and into a radiation range of said X ray excitation unit, a said characteristic X ray spectra fluorescence being generated by said ore;

Step 4, a receiving said characteristic X ray spectra fluorescence by said characteristic spectral receiving unit, said characteristic X ray spectra fluorescence being input to said spectral acquisition system to process into spectral signals;

Step 5, transmitting said spectral signals to said industrial computer from said spectral acquisition system, said industrial computer comparing said spectral signals with said sorting parameters so as to obtain sorting instructions as output to said separator through said instruction output system;

Step 6, executing said sorting instructions with said separator unit;

Step 7, repeating Step 3 to Step 6.

* * * * *